US010020557B2

(12) United States Patent
Hu

(10) Patent No.: US 10,020,557 B2
(45) Date of Patent: Jul. 10, 2018

(54) HOLDER AND ANTENNA FIXING DEVICE USING THE SAME

(71) Applicant: NANNING FUGUI PRECISION INDUSTRIAL CO., LTD, Nanning (CN)

(72) Inventor: Kun-Rui Hu, Shenzhen (CN)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 15/142,265

(22) Filed: Apr. 29, 2016

(65) Prior Publication Data

US 2017/0207512 A1 Jul. 20, 2017

(30) Foreign Application Priority Data

Jan. 16, 2016 (CN) ..... 2016 1 0026293

(51) Int. Cl.
*H01Q 1/42* (2006.01)
*H01Q 1/12* (2006.01)
*H01Q 1/22* (2006.01)

(52) U.S. Cl.
CPC ..... *H01Q 1/1221* (2013.01); *H01Q 1/2291* (2013.01)

(58) Field of Classification Search
CPC ..... H01Q 1/12; H01Q 1/22
USPC ..... 248/291.1, 292.13; 343/702, 718, 872
See application file for complete search history.

(56) References Cited

U.S. PATENT DOCUMENTS

| | | | | |
|---|---|---|---|---|
| 6,710,747 | B1 * | 3/2004 | Chang | H01Q 1/084 343/702 |
| 7,046,212 | B2 * | 5/2006 | Tai | H01Q 1/084 343/872 |
| 8,299,372 | B2 * | 10/2012 | Swais | H01Q 1/00 174/377 |
| 2009/0322645 | A1 * | 12/2009 | Sun | H01Q 1/42 343/872 |
| 2010/0001910 | A1 * | 1/2010 | Kawaguchi | H01Q 1/3275 343/711 |
| 2011/0017899 | A1 * | 1/2011 | Lerchner | H01Q 1/1214 248/534 |
| 2015/0303578 | A1 * | 10/2015 | Yoshikawa | H01Q 3/06 343/702 |

FOREIGN PATENT DOCUMENTS

| | | |
|---|---|---|
| TW | M294226 | 7/2006 |
| TW | 200703767 | 1/2007 |
| TW | M439274 U1 | 10/2012 |
| TW | M449965 U1 | 4/2013 |
| TW | 201525658 A | 7/2015 |

* cited by examiner

*Primary Examiner* — Steven M Marsh
(74) *Attorney, Agent, or Firm* — ScienBiziP, P.C.

(57) ABSTRACT

An antenna fixed device includes a holder with a chassis and an antenna assembly. The holder includes a second resisting arm and a third resisting arm. The second resisting arm extends from the chassis and includes a protruding portion. The third resisting arm extends from the chassis and is configured to resisting the antenna assembly. When the protruding portion is pressed, the third resisting arm can be disconnected from the antenna assembly conveniently and efficiently.

21 Claims, 8 Drawing Sheets

HOLDER AND ANTENNA FIXING DEVICE USING THE SAME

FIELD

The subject matter herein generally relates to holders, particularly to a holder with an antenna fixed device using the holder.

BACKGROUND

Antennas are usually assembled on a plurality of electronic devices, such as wireless router. However the antenna are fixed on a shell of the wireless router by a conventional fixed manner in a joint of the shell, which can lead the antenna cannot be disassembled from the shell of the electronic device or the antenna may be damaged during disassembly.

BRIEF DESCRIPTION OF THE DRAWINGS

Implementations of the present technology will now be described, by way of example only, with reference to the attached fingers.

DETAILED DESCRIPTION

Figure 1:
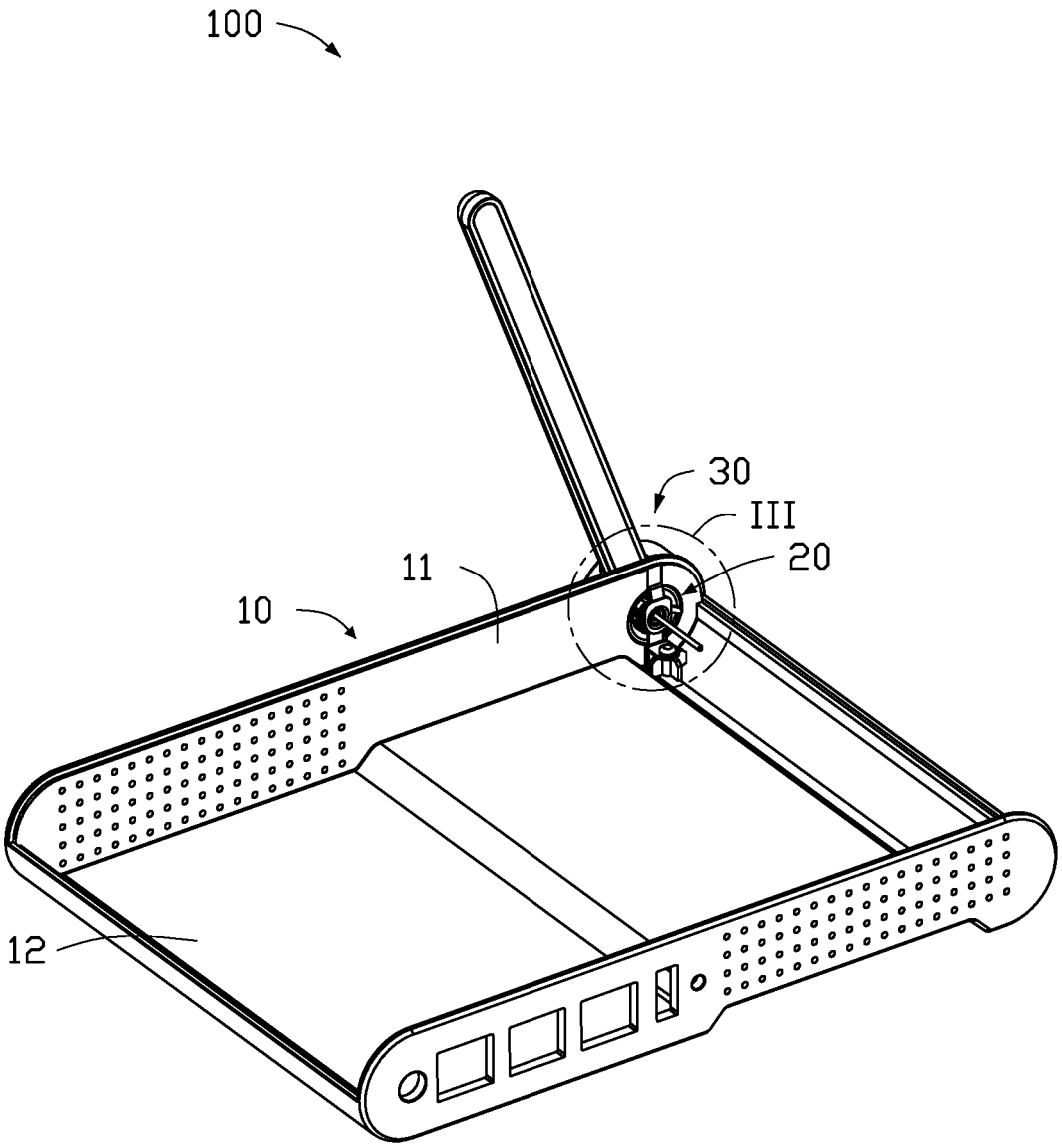
FIG. 1 is an schematic view of an antenna fixed device according to a first exemplary embodiment, wherein the antenna fixed device includes a main body, a holder, and an antenna assembly tilted with respect to the main body.

It will be appreciated that for simplicity and clarity of illustration, where appropriate, reference numerals have been repeated among the different fingers to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series and the like.

The disclosure is described in relation to an antenna fixed device.

Figure 2:
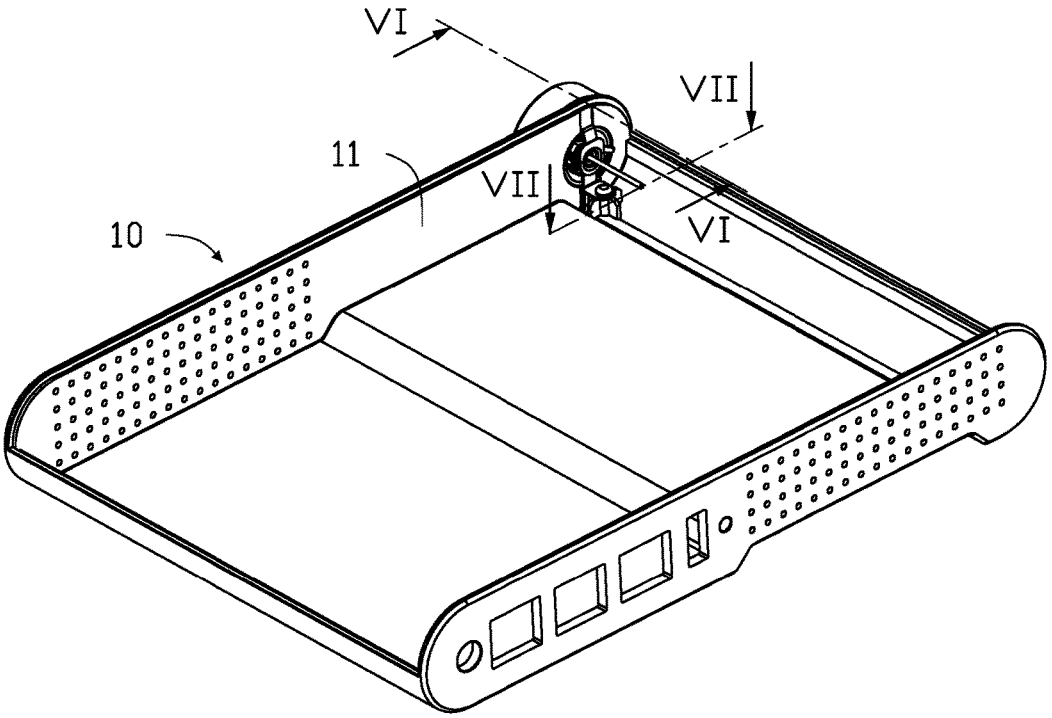
FIG. 2 is an schematic view of the antenna assembly of the antenna fixed device in horizontal with the main body in FIG. 1.

FIGS. 1 and 2 illustrate schematic views of an antenna fixed device 100 according to one exemplary embodiment. The antenna fixed device 100 is configured to detachably secure an antenna assembly 30, and includes a main body 10 and a holder 20. The antenna fixing device 100 has a structure that the antenna assembly 30 can be detached easily therefrom.

Figure 3:
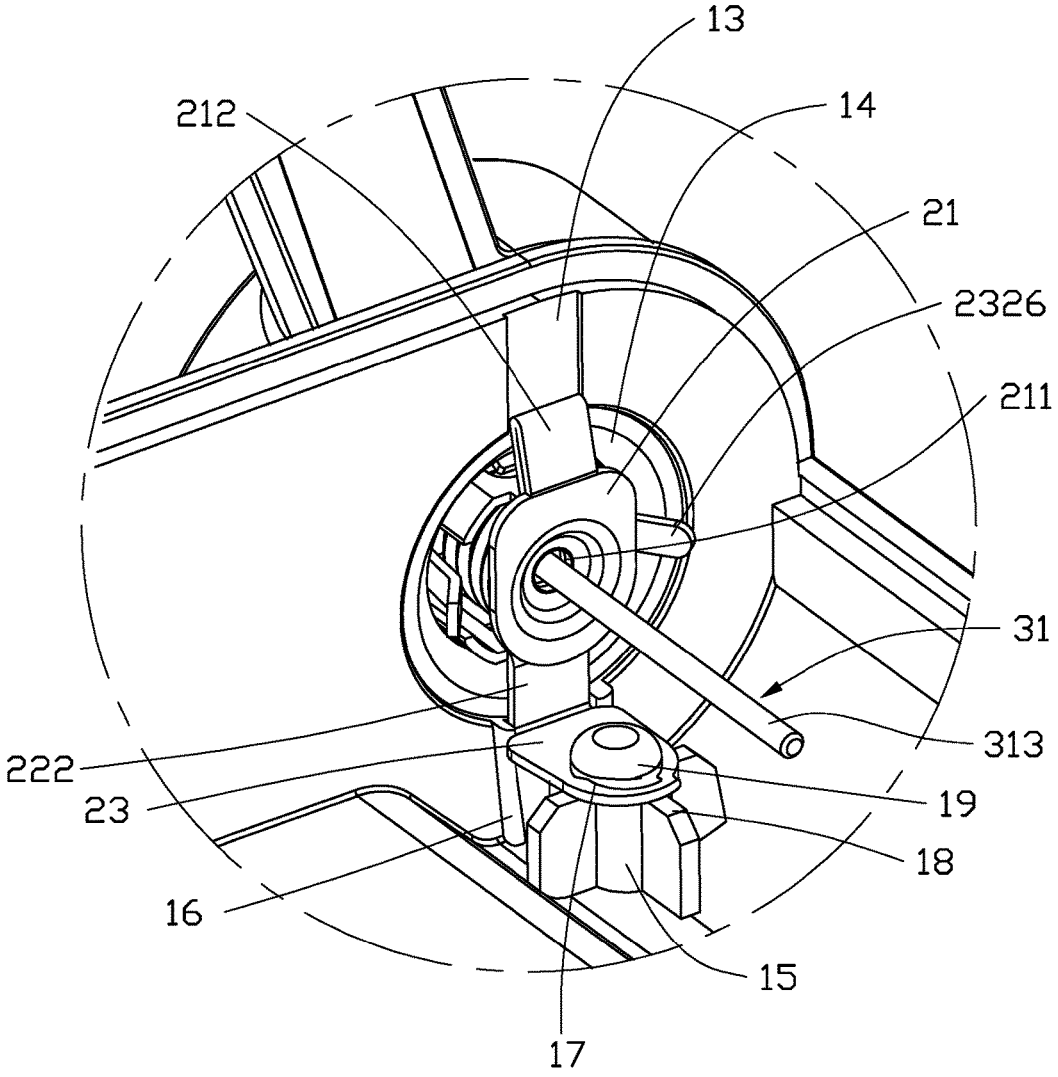
FIG. 3 is a partial enlarged view of the antenna fixed device shown in FIG. 1.

The main body 10 includes side wall(s) 11 and a bottom wall 12. See also FIG. 3 providing a partial enlarged view of the antenna fixed device 100 shown in FIG. 1. The side wall 11 defines a limit groove 13 and an axle hole 14. The bottom wall 12 includes a main column 15 and at least one limit column 16. In the exemplary embodiment, number of the limit column 16 is two. The main column 15 protrudes from the bottom wall 12, along a direction approximately perpendicular to the bottom wall 12. The main column 15 has a first surface 18 and a threaded hole 17. The first surface 18 disposed opposite to the bottom wall 12. The threaded hole 17 is recessed from the first surface 18, and extending into the main column 15, along a direction approximately perpendicular to the main column.

Figure 4:
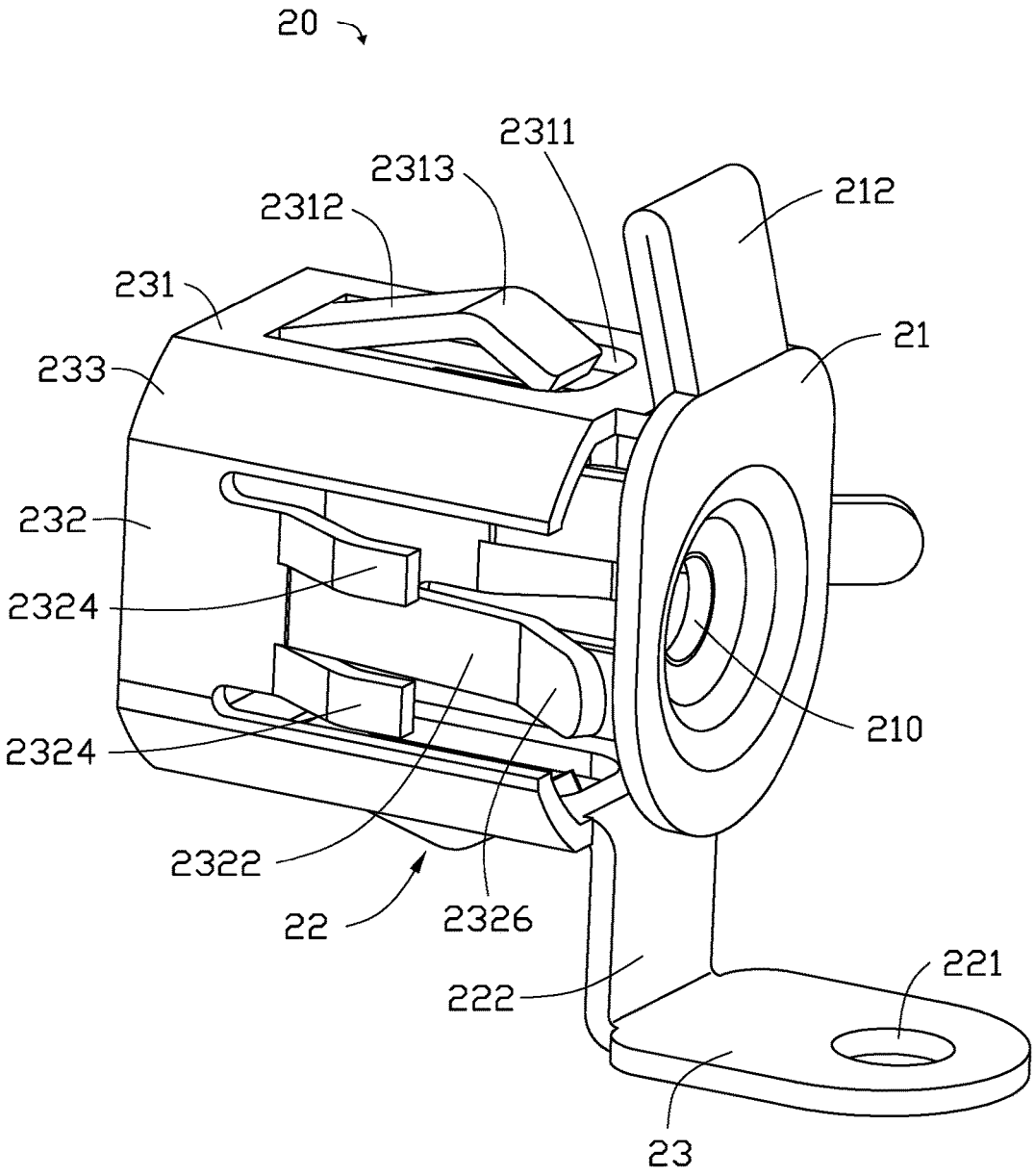
FIG. 4 is a schematic view of the holder as shown in FIG. 1.

FIG. 4 is a schematic view of the holder 20 as shown in FIG. 1. The holder 20 includes a side panel 21, a mounting board 23, and a chassis 22. The side panel 21 has a first through hole 210 and a first supporting arm 212. The first through hole 210 is defined in a central portion the side panel 21. The first supporting arm 212 connects the side panel 21 and the chassis 22. In detail, the first supporting arm 212 extends outwards from and edge of the side panel 21 firstly, then bending inwards to the side panel 21, and finally connects to an edge of the chassis 22. The mounting board 23 has a second through hole 221, and a second supporting arm 222. A second supporting arm 222 extends outwards from the edge of the mounting board 23.

The chassis 22 is preferably to be in a shape of hollow rectangle, and includes two first walls 231 opposed to each other, two second walls 232 opposite to each other, and four corner third walls 233. Each third wall 233 is positioned between and connects to a first wall 231 and a second wall 232. Each of the second walls 232 includes two third resisting arms 2324 and a second resisting arm 2322. The second resisting arm 2322 is positioned between the two third resisting arm 2324 of the same second wall 232. The two third resisting arm 2324 and the second resisting arm 2322 are elastic, and extend from an edge of corresponding second opposite wall 232 towards the side panel 21. Height of each third resisting arm is less than that of the second resisting arm 2322. Each of the second resisting arm 2322 includes a protruding portion 2326. The second resisting arm 2322 can be elastically deformed, e.g bend inwardly, by pressing the protruding portion 2326. The third walls 233 can be elastically deformed, e.g bend outwardly. Each of the second opposite walls 231 defines an opening 2311. A first resisting arm 2312 flexibly extends from an edge of the opening 2311 to another opposite edge of the opening 2311, and includes a resisting portion 2313.

Figure 5:
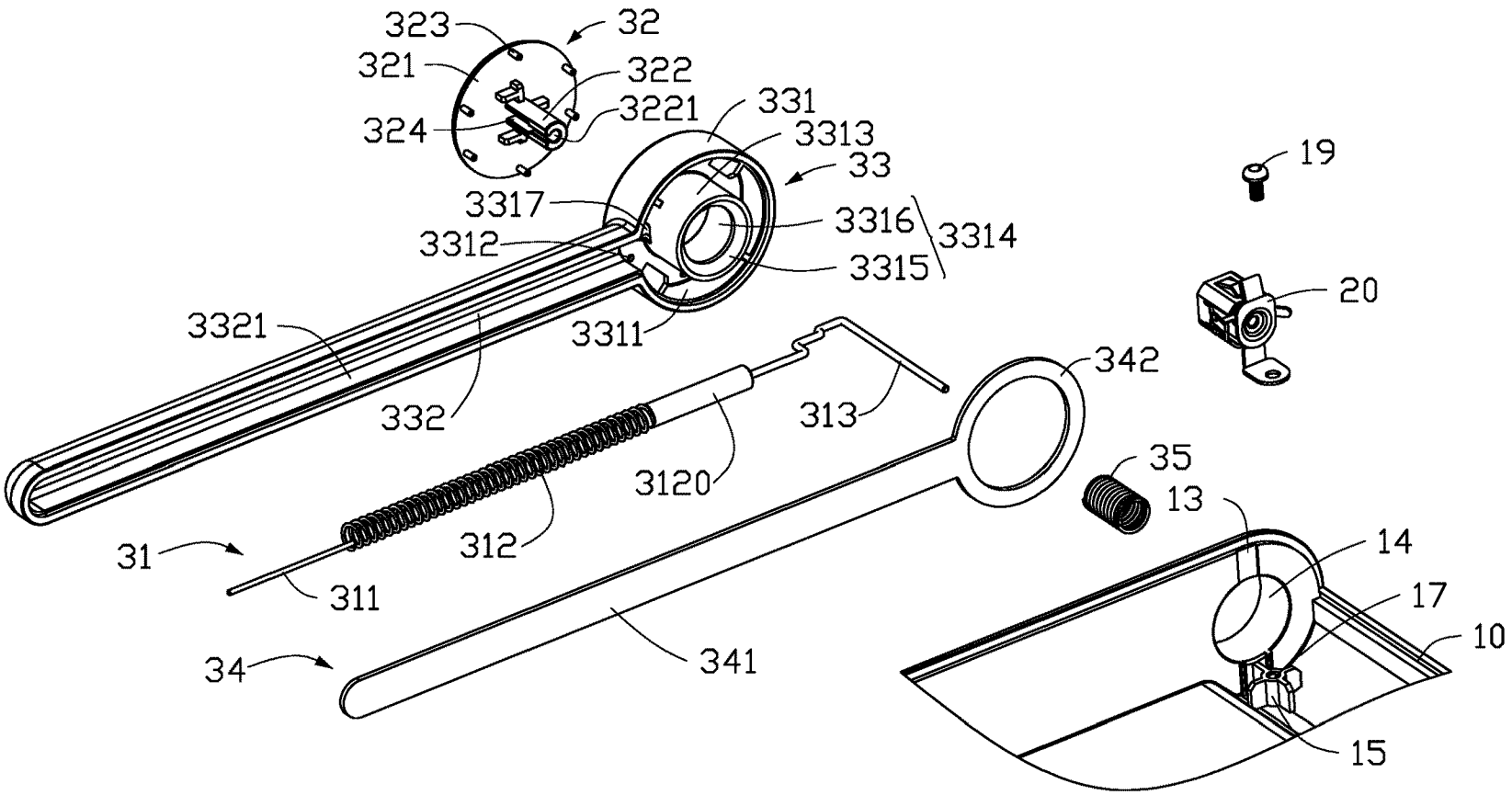
FIG. 5 is an exploded view of the antenna fixed device shown in FIG. 3.

Referring to FIG. 5, the antenna assembly 30 includes an antenna 31, a base plate 32, a shell 33, a cover 34, and a spring 35. The shell 33 is coupled to the cover 34, and is configured to receive the antenna 31 therebetween. The base plate 32 is fixed on one terminal of the shell 33.

The antenna 31 includes a straight portion 311, a coiled portion 312, and a support portion 313. A terminal of the coiled portion 312 is coupled to the straight portion 311. The straight portion 311 is linear. The coiled portion 312 includes a straight extension portion 3120. The extension portion 3120 of the coiled portion 312 is coupled to the support portion 313. The support portion 313 is generally L-shaped.

The base plate 32 includes a bottom surface 321, a fixed portion 322, and a plurality of positioning pins 323. The fixed portion 322 approximately protrudes from a central portion of the bottom surface 321, and defines a first receiving groove 3221 and a connecting portion 324. The first receiving groove 3221 is configured to receive the support portion 313. The first receiving groove 3221 axially extends in the fixing portion 322, and communicates with ambient air through the connecting portion 324. The spring 35 is located around the fixed portion 322. The positioning portion 323 has a number of six, and are equally spaced positioned on a peripheral portion of the bottom surface 321.

The shell 33 includes a hinge portion 331 and a receiving portion 332 extending from the hinge portion 331. The rotation portion 332 defines a second receiving groove 3321 to receive the antenna 31. The hinge portion 331 includes a base surface 3311, a plurality of positioning holes 3312, and a central shaft 3313. The position holes 3312 has a number and position according to the positioning pins 313, and are defined on the base surface 3311, to correspondingly couple to the six located portions 323 of the base plate 32. The center spindle 3313 includes a first spindle portion 3315 and a second spindle portion 3316, and defines a center hole 3314 through the first spindle portion 3315 and a second spindle portion 3316. A diameter of the first spindle portion 3315 is greater than that of the second spindle portion 3316. The first spindle portion 3315 is an angular surface and connects to the second shaft portion 3316 through a smaller end thereof. A bottom of the second spindle portion 3316 defines a through hole 3317 through a portion adjacent to the base surface 3311. The through hole 3317 is defined to be passed through by the support portion 313 of the antenna 31. The through hole 3317 communicates with the second receiving groove 3321.

The cover 34 includes a straight section 341 and a circular section 342 connecting to the straight section 341. The straight cover 341 and the ring cover 342 are correspondingly coupled to the rotation portion 332 and the hinge portion 331 of the shell 33, respectively.

Figure 6:
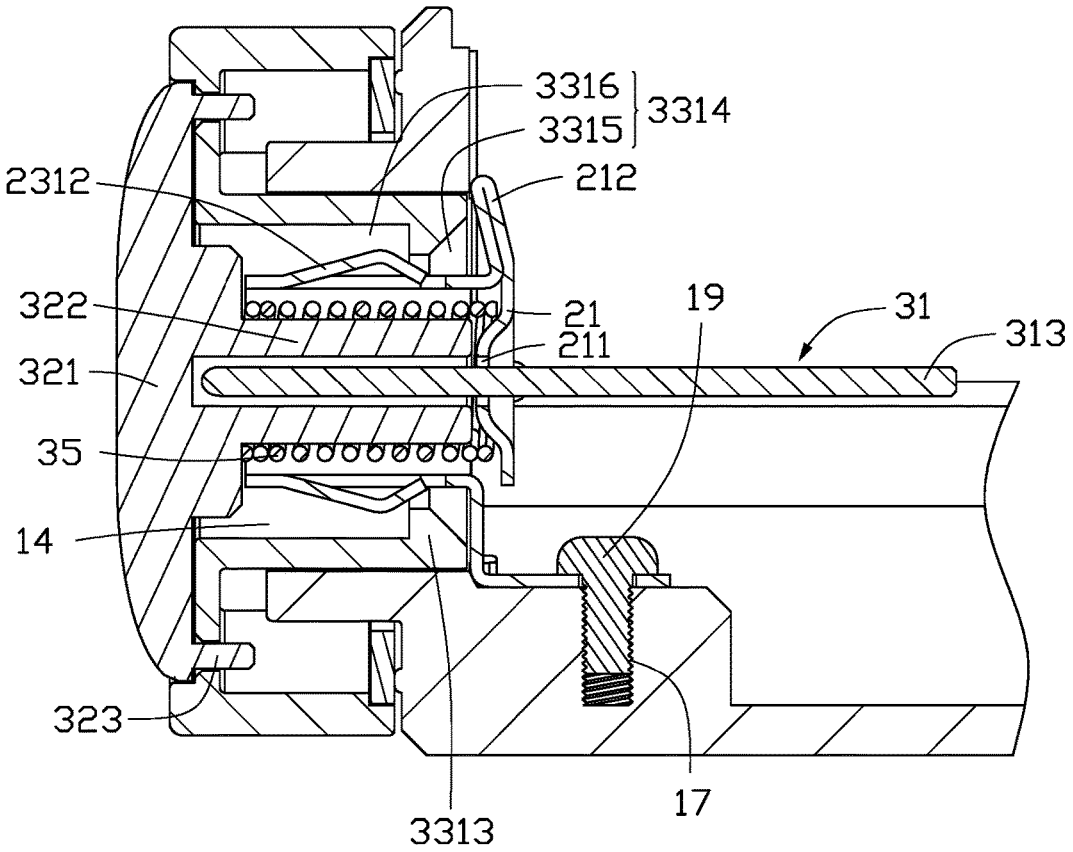
FIG. 6 is a sectional view taken along line VI-VI of FIG. 2.
Figure 7:
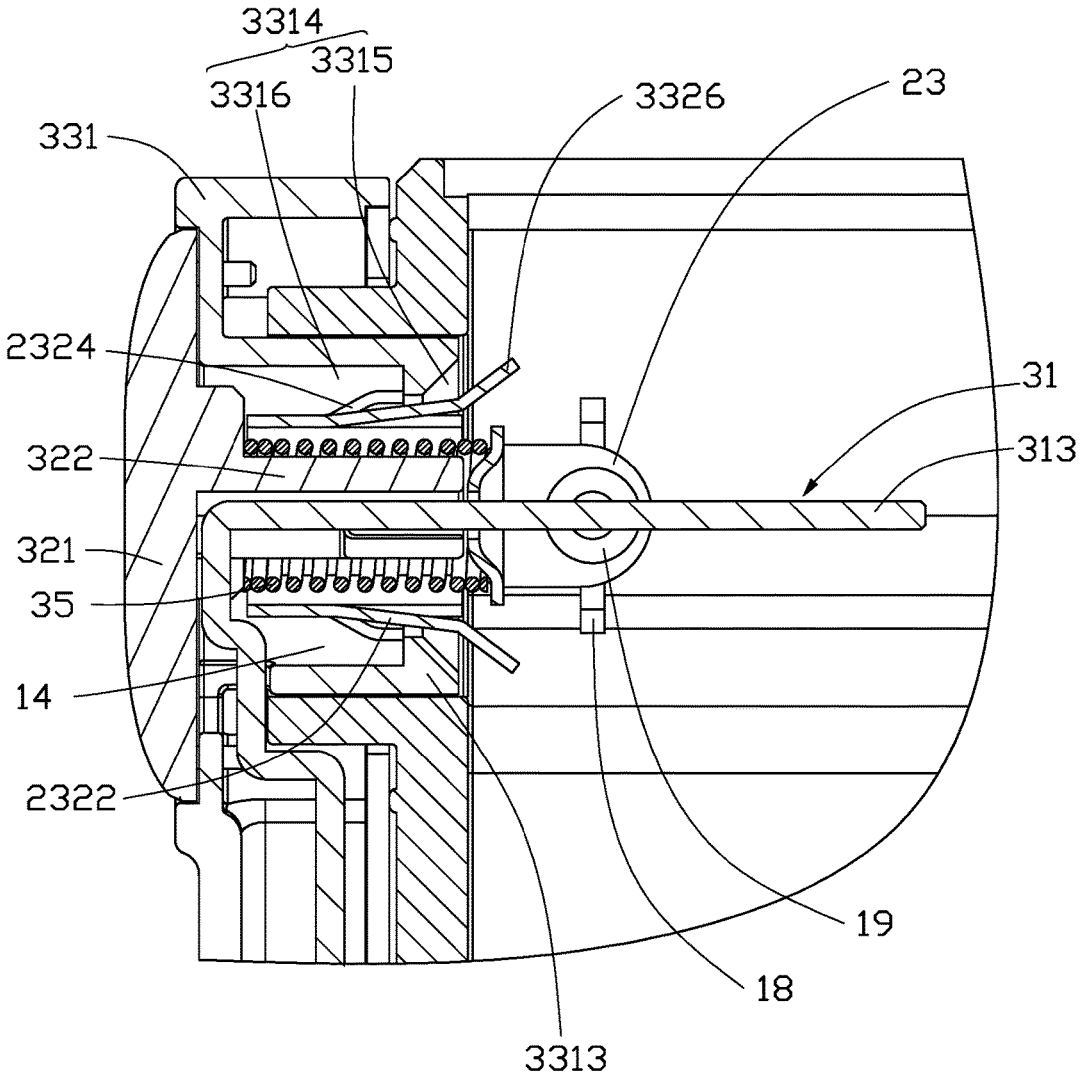
FIG. 7 is a partial sectional view taken along line VII-VII of FIG. 2.

Referring to FIGS. 6 and 7, in assembly, the support portion 313 of the antenna 31 passes through the through hole 3317 and the center hole 3314. The straight portion 311 and the coiled portion 312 are received in the second receiving groove 3321 of the shell 33. The located portions 323 of the base plate 32 are fixed to the position holes 3312 of the hinge portion 331 of the shell 33 through hot melting technology. The fixed portion 322 of the base plate 32 and the spring 35 out of the fixed portion 322 are inserted into the center hole 3314 of the shell 33. The support portion 313 is received in the first receiving groove 3221 of the fixed portion 322 of the base plate 322 through the connecting portion 324. The cover 34 is fixed on the shell 33 by a manner of hot melting. The ring cover 342 of the cover 34 cover the hinge portion 331 of the shell 33. The straight cover 341 of the cover 34 covers the rotation portion 332 of the shell 33.

The mounting board 23 of the holder 20 is positioned on the first surface 18, and is fixed to the main column 15 through a screw 19 threadly engaging with the threaded hole 17. Therefore, the holder 20 is secured to the main body 10. The chassis 22 is inserted into the axle hole 14 of the main body 10. The first supporting arm 212 is fitly positioned in the limit groove 13. The second supporting arm 222 is fitly positioned between and resists against the limit column 16, to prevent rotation of the holder 20.

The center spindle 3313 of the shell 33 is inserted into the axle hole 14 of the main body 10. A second terminal 3131 of the support portion 313 passes through the first through hole 210 of the main body 21 and extends into the main body 10, for coupling to other functional electronic component. The fixed portion 322 is received in the chassis 22. The spring 35 is compressed between the connecting portion 324 and the side panel 21 of the chassis 22. The central shaft 3316 receives the chassis 22. The two third resisting arms 2324 elastically resisting against the central shaft 3316. The engagement between the first supporting arm 212 and the limit groove 13, the engagement between the second supporting arm 222 and the limit column 16 cooperatively avoid axialmovements of the holder 20. The edge portion 3326 of the receiving portion 332 protrudes out of the axle hole 14 to facilitating operation to the edge portion 3326 by users.

When the two protruding portions 2326 are pressed towards each other, the second resisting arms 2322 of the first opposite walls 232 jointly bend towards each other, to make the two third resisting arms 2324 are disengaged from the center hole 3314 of the shell 33. Therefore, the antenna assembly 30 can be disconnected from the holder 20 conveniently and efficiently.

Figure 8:
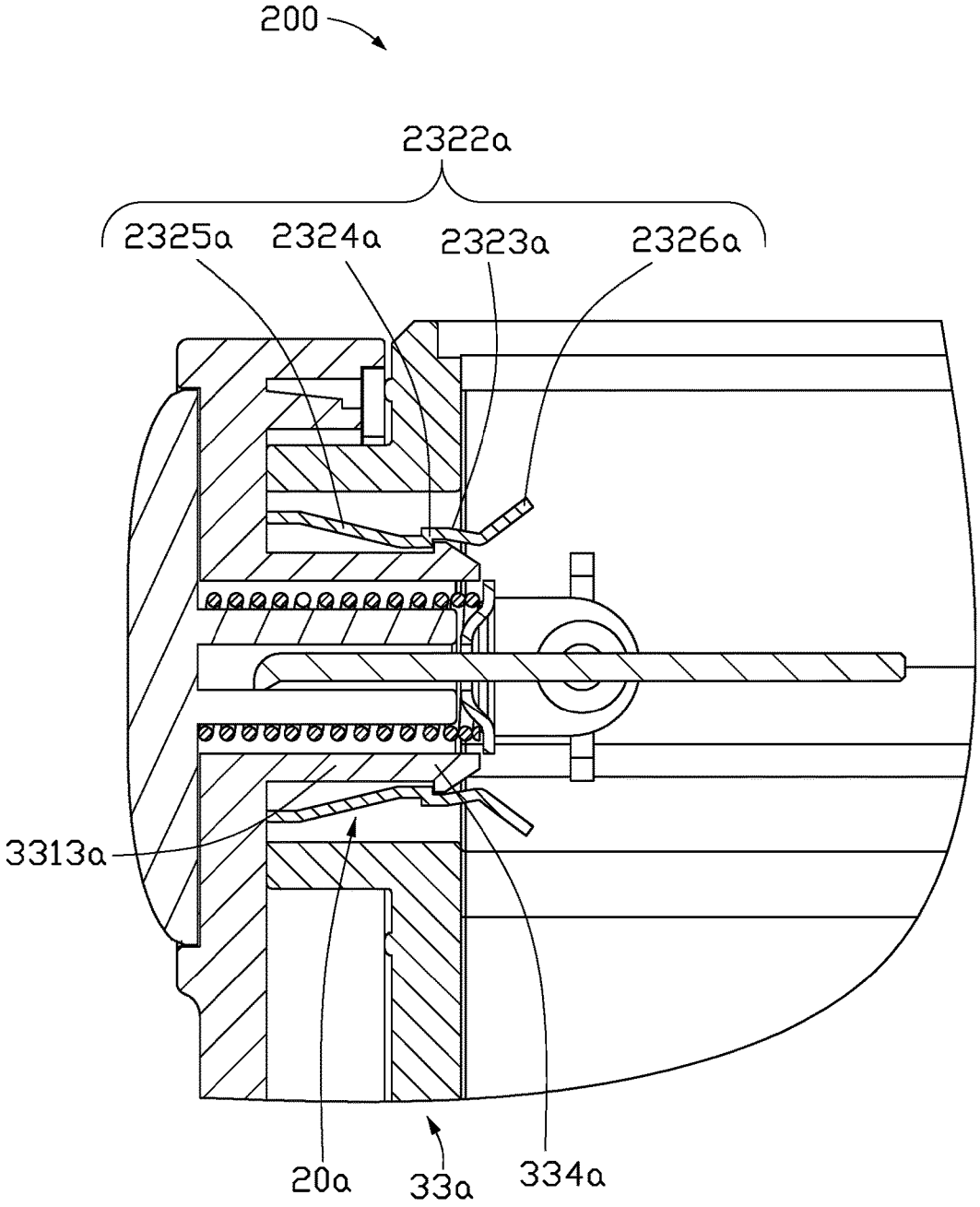
FIG. 8 is a partial sectional view of the antenna fixed device according to a second exemplary embodiment.

FIG. 8 is a partial sectional view of the antenna fixed device 200 according to a second exemplary embodiment. In the embodiment, the holder 20*a* and shell 33*a* of the antenna fixed device 200 are different from that of the first exemplary embodiment. The second resisting arm 2322*a* includes an upper portion 2323*a*, a connection portion 2324*a*, and a lower portion 2325*a*. The connection portion 2324*a* is straight-shaped. Both of the upper portion 2323*a* and the lower portion 2325*a* are slanted a certain angle with relative to the connection portion 2324*a*. The upper portion 2323*a* includes a protruding portion 2326*a*, to make the antenna assembly 30*a* can be disconnected from the holder 20*a* conveniently. The shell 33*a* includes a center spindle 3313*a* with a stop portion 334*a* to resisting the connection portion 2324*a*. When the protruding portion 2326*a* is pressed, connection portion 2324*a* of the second resisting arm 2322*a* are disconnected from the center spindle 3313*a* of the shell 33. Then, the antenna assembly 30*a* can be disconnected from the holder 20*a* conveniently and efficiently.

While the disclosure has been described by way of example and in terms of the embodiment, it is to be understood that the disclosure is not limited thereto. On the contrary, it is intended to cover various modifications and similar arrangements as would be apparent to those skilled in the art. Therefore, the range of the appended claims should be accorded the broadest interpretation so as to encompass all such modifications and similar arrangements.

What is claimed is:

1. A holder comprising a chassis, the chassis comprising:

a second resisting arm comprising a protruding portion; and;

a third resisting arm configured to connect with a fastener;

a side panel;

a mounting board;

a first supporting arm extending from an edge of the side panel; and a second supporting arm extending from an edge of the mounting board;

wherein when the protruding portion is pressed, the third resisting arm can be disconnected from the fastener;

wherein side panel defines a first through hole, both of the first supporting arm and the second supporting arm are coupled to the chassis, and the mounting board is perpendicular to the side panel.

2. The holder according to claim 1, further comprising two opposite first walls, wherein the second resisting arm and the third resisting arm flexibly extend from an edge of one of the opposite first walls in a direction away from the chassis.

3. The holder according to claim 2, further comprising two opposite second walls, wherein each one of the opposite second walls defines an opening and comprises a first resisting arm flexibly extending from an edge of the opening to an opposite edge of the opening.

4. The holder according to claim 3, wherein the chassis comprises four third walls, each one of the opposite second walls is coupled to an opposite first wall through one corresponding third wall.

5. The holder according to claim 1, wherein the chassis has a shape of a hollow cylinder.

6. The holder according to claim 1, wherein the number of the third resisting arms is two, the second resisting arm is positioned between the two third resisting arms.

7. The holder according to claim 6, wherein height of each third resisting arm is less than the height of the second resisting arm.

8. An antenna fixing device, comprising:

an antenna assembly; and a holder comprising a chassis, the chassis comprising:

a second resisting arm extending from the chassis, and comprising a protruding portion; and a third resisting arm extending from the chassis, and configured to resisting the antenna assembly;

wherein when the protruding portion is pressed, the third resisting arm can be disconnected from the antenna assembly.

9. The antenna fixed device according to claim 8, further comprising two first opposite walls, wherein the second resisting arm and the third resisting arm flexibly extend from an edge of one first opposite wall in a direction away from the chassis.

10. The antenna fixed device according to claim 9, further comprising two second opposite walls, wherein each one of the second opposite walls defines an opening and comprises a first resisting arm flexibly extending from an edge of the opening to another opposite edge of the opening; and the first resisting arm comprises a resisting portion.

11. The antenna fixed device according to claim 8, further comprising a side panel, a mounting board, a first supporting arm, and a second supporting arm, wherein side panel defines a first through hole, the first supporting arm extends from an edge of the side panel, the second supporting arm extends from an edge of the mounting board, and both of the first supporting arm and the second supporting arm are coupled to the chassis.

12. The antenna fixed device according to claim 8, wherein number of the third resisting arm is two, the second resisting arm is positioned between the two third resisting arms, and height of each third resisting arm is less than that of the second resisting arm.

13. The antenna fixed device according to claim 8, further comprising a main body, wherein the main body comprises a side wall and a bottom wall, the side wall defines a limit groove and an axle hole, the mounting board of the holder is fixed on the main body, the chassis is coupled to the main body through the axle hole.

14. The antenna fixed device according to claim 8, wherein the antenna assembly comprises an antenna, a base plate, a shell, and a cover; the shell is coupled to the cover and is configured to receive the antenna; the base plate is fixed on the shell.

15. The antenna fixed device according to claim 14, wherein the antenna comprises a straight portion, a coiled portion, and a support portion; the coiled portion is coupled between the straight portion and the support portion; the coiled portion comprises an extension portion with straight-shaped; the support portion is generally shaped as right angle.

16. The antenna fixed device according to claim 14, wherein the base plate comprises a bottom surface, a fixed portion, and a plurality of located portion; the fixed portion defines a first receiving groove to receive the support portion of the antenna; the spring is located out of the fixed portion.

17. The antenna fixed device according to claim 14, wherein the shell comprises a hinge portion and a rotation portion extending from the hinge portion; the rotation portion defines a second receiving groove to receiving the antenna; the hinge portion comprises a bottom surface, a plurality of position holes, and a center spindle; the plurality of position holes number six, and are defined on the bottom surface to correspondingly couple to the six located portions of the base plate; the center spindle comprises a first spindle portion and a second spindle portion, and defines a center hole through the first spindle portion and a second spindle portion; a diameter of the first spindle portion is greater than that of the second spindle portion.

18. The antenna fixed device according to claim 17, wherein a bottom of the second spindle portion adjacent to the bottom surface defines a through hole; the through hole can be passed through by the support portion of the antenna.

19. The antenna fixed device according to claim 8 wherein the second resisting arm comprises an upper portion, a connection portion, and a lower portion; the connection portion is straight-shaped; both of the upper portion and the lower portion are slanted a certain angle with relative to the connection portion; the upper portion comprises a protruding portion to make the antenna assembly can be disconnected from the holder by pressing the protruding portion.

20. The holder according to claim 1, wherein the first supporting arm extends outwards from and edge of the side panel firstly, then bending inwards to the side panel, and finally connects to an edge of the chassis.

21. A holder comprising a chassis, the chassis comprising:

a second resisting arm comprising a protruding portion;

a third resisting arm configured to resisting a fastener;

two first opposite walls;

two second opposite walls; and four third walls;

wherein when the protruding portion is pressed, the third resisting arm can be disconnected from the fastener;

wherein each one of the second opposite walls is coupled to the adjacent first opposite wall through one corresponding third wall.

* * * * *